United States Patent [19]

Steenson et al.

[11] 4,117,639

[45] Oct. 3, 1978

[54] REINFORCED INSULATED CONCRETE BUILDING PANEL

[75] Inventors: Thomas William Steenson, Richmond Hill; W. Donald Paton, Aurora, Canada

[73] Assignee: Butler Manufacturing Company, Kansas City, Mo.

[21] Appl. No.: 811,300

[22] Filed: Jun. 29, 1977

[51] Int. Cl.[2] ..... E04B 1/16; E04B 2/28

[52] U.S. Cl. ..... 52/223 R; 52/378; 52/410; 52/576; 52/687

[58] Field of Search ..... 52/309.11, 309.12, 309.14, 52/378, 410, 576, 679, 687, 383, 223 R; 264/253

[56] References Cited

U.S. PATENT DOCUMENTS

| | | | |
|---|---|---|---|
| 1,511,658 | 10/1924 | Crowe | 52/679 |
| 2,630,615 | 3/1953 | Moore | 52/383 X |
| 2,634,603 | 4/1953 | Byars et al. | 52/679 |
| 2,653,469 | 9/1953 | Callan | 52/410 X |
| 3,237,357 | 3/1966 | Hutchings | 52/410 X |
| 3,295,278 | 1/1967 | Muhm | 52/410 X |
| 3,438,161 | 4/1969 | Koch | 52/309.12 X |

FOREIGN PATENT DOCUMENTS

| | | | |
|---|---|---|---|
| 1,609,660 | 2/1973 | Fed. Rep. of Germany | 52/410 |

OTHER PUBLICATIONS

Journal of the American Concrete Institute, Sep. 1952, pp. 40–44.

*Primary Examiner*—Alfred C. Perham
*Attorney, Agent, or Firm*—Shoemaker and Mattare

[57] ABSTRACT

A reinforced insulated concrete building panel has an inner layer of concrete and an outer layer of concrete, with a layer of insulating material sandwiched therebetween. Shear connectors are embedded in the layer of concrete and extend from the outer layer through the layer of insulation and into the inner layer to prevent delamination of the panel during handling. The shear connectors have projecting portions defining a depth gauge to indicate when the connector has been inserted a proper distance into the panel during construction of the panel. The method of constructing the panel comprises the steps of casting one of the layers of concrete and immediately thereafter placing the layer of insulation thereover and then inserting the shear connectors through the insulation and into the cast layer of concrete until the depth gauge portion of the shear connectors engage the insulation, thereby accurately positioning the shear connectors, and thereafter casting a second layer of concrete on top of the layer of insulation.

3 Claims, 6 Drawing Figures

FIG. 1.
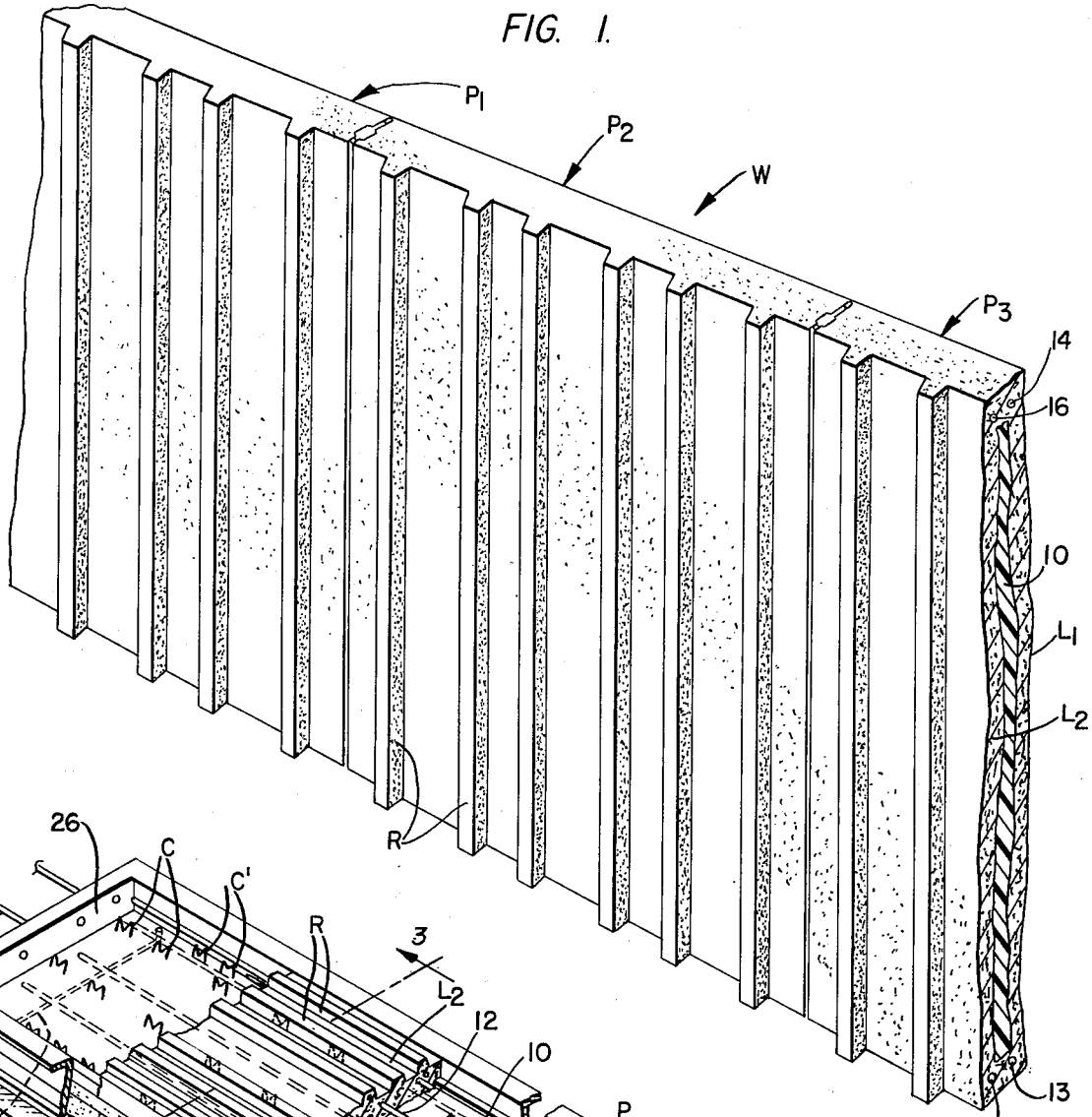
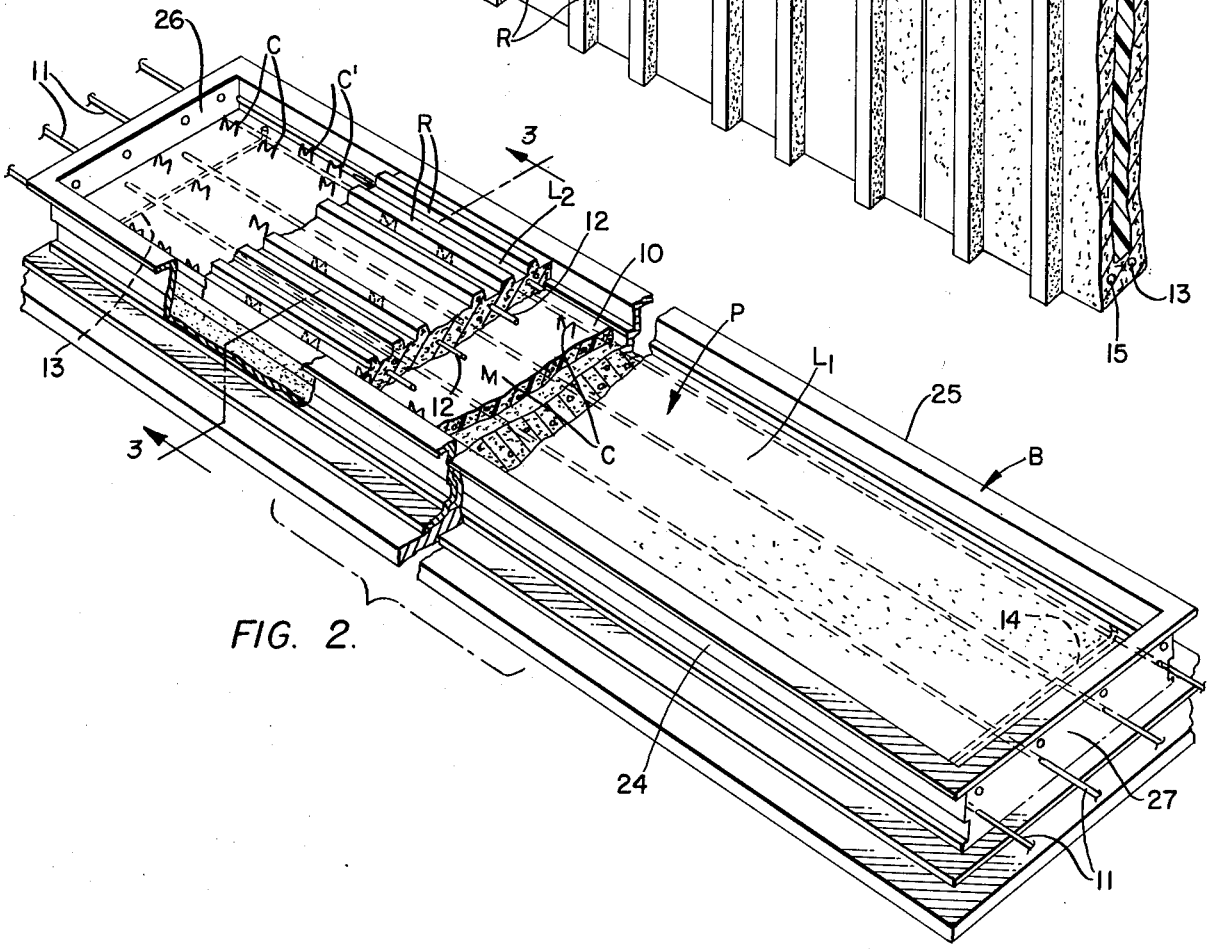
FIG. 2.

REINFORCED INSULATED CONCRETE BUILDING PANEL

BACKGROUND OF THE INVENTION

This invention relates generally to concrete building panels, and more particularly to such building panels comprising a laminated structure wherein an inner layer of concrete and an outer layer of concrete have a layer of insulating material sandwiched therebetween. With such panels it is necessary to provide some form of reinforcing means or connectors extending between the layers of concrete through the insulation to prevent delamination failure of the panels.

In the prior art, various means have been used. For example, with early panels of the insulated type, expanded wire mesh was installed between joints in the insulation and extending between the layers of concrete. This type of construction had the disadvantage of requiring a space between the joints of insulation and further the insulation joints needed to be in a special pattern to suit the requirements of the shear connectors. Another prior art method comprised the securement, as by welding or the like, of a piece of reinforcing rod, such as ¼ inch diameter steel rod, to the reinforcing strands or steel in the bottom or first cast layer of concrete, with a part of the reinforcing rod projecting upwardly. The layer of insulation was then pushed downwardly over the upwardly projecting piece of steel and the steel was thereafter bent over the insulation to anchor the insulation and steel in place. The second layer of concrete was thereafter cast over the layer of insulation. While this arrangement was structurally sound, excessive labor was required to install the upwardly projecting lengths of steel.

Later, with the introduction of prestressed concrete insulated panels, the type of shear connectors used had to be changed, since there is no reinforcing steel in the bottom layer of concrete to which the shear connectors could be attached. However, in such prestressed panels, there generally always were prestressed steel strands present in the top layer of concrete and a U-shaped shear connector was developed which was pushed downwardly through the layer of insulation over the reinforcing strands. The strands thereby regulated the depth to which the connectors were inserted. However, such a construction required that the layer of insulation be installed over the bottom layer of concrete and then the reinforcing strands placed and stressed. This procedure frequently resulted in too much time passing between the casting of the bottom layer of concrete and the placement of the shear connectors, with the result that the concrete in the bottom layer would be partly set up before the shear connectors were installed and the bonding between the concrete in the bottom layer and the shear connectors was thus not sufficient. Consequently, these panels sometimes experienced a delamination failure. The situation was rendered more acute on production lines wherein a long casting bed was used for a long line production or where relatively complicated panels with time consuming steps were utilized. One attempt made to solve the above problem was to make the shear connectors of such a length that when they were pushed through the layer of insulation and the bottom layer of concrete, they would extend into contact with the form for the bottom layer of concrete. However, this structure resulted in a thin layer of concrete over the shear connectors in the bottom layer, which tended to spall from the panel during handling.

The present invention, on the other hand, provides a simple and economical shear connector which may be quickly and easily placed through the layer of insulation and bottom layer of concrete and the shear connector has a projection thereon defining a depth gauge to automatically indicate when the shear connector has been installed to the proper depth. The shear connector may thus be positioned immediately after casting the bottom layer of concrete and prior to the time the reinforcing strands are installed and stressed.

OBJECTS OF THE INVENTION

Accordingly, it is an object of this invention to provide a reinforced insulated concrete building panel which includes inner and outer layers of concrete with a layer of insulating material sandwiched therebetween, and wherein a unique shear connector extends through the insulation into the layers of concrete to provide a composite structure which is not subject to delamination failure and wherein the shear connector has a projection thereon defining a depth gauge to automatically indicate the proper depth of insertion of the shear connector through the insulation and into one of the layers of concrete.

Another object of the invention is to provide a shear connector for use in insulated concrete building panels wherein the shear connector has a length such as to extend into each layer of concrete through the layer of insulation and the shear connector has a portion thereof formed to define a depth gauge to indicate the proper positioning of the shear connector relative to the layer of insulation.

A still further object is to provide a method of manufacturing a reinforced insulated concrete panel wherein a bottom layer of concrete is cast and a layer of insulating material is placed thereon and a plurality of shear connectors are then inserted through the insulating material and into the bottom layer of concrete, and wherein the shear connectors have portions thereof defining depth gauges to automatically indicate the proper degree of insertion of the shear connectors through the layer of insulation into the bottom layer of concrete, and thereafter a top layer of concrete is cast over the layer of insulation and around the exposed portions of the shear connectors to define a composite reinforced concrete insulated building panel.

BRIEF DESCRIPTION OF THE DRAWINGS

FIG. 1 is a fragmentary perspective view of a portion of a wall comprising reinforced insulated concrete panels according to the invention.

FIG. 2 is a perspective view with portions broken away and portions shown in section of a casting bed for casting a panel in accordance with the invention, and showing the various components of a panel in accordance with the invention.

DETAILED DESCRIPTION OF THE INVENTION

Figure 3:
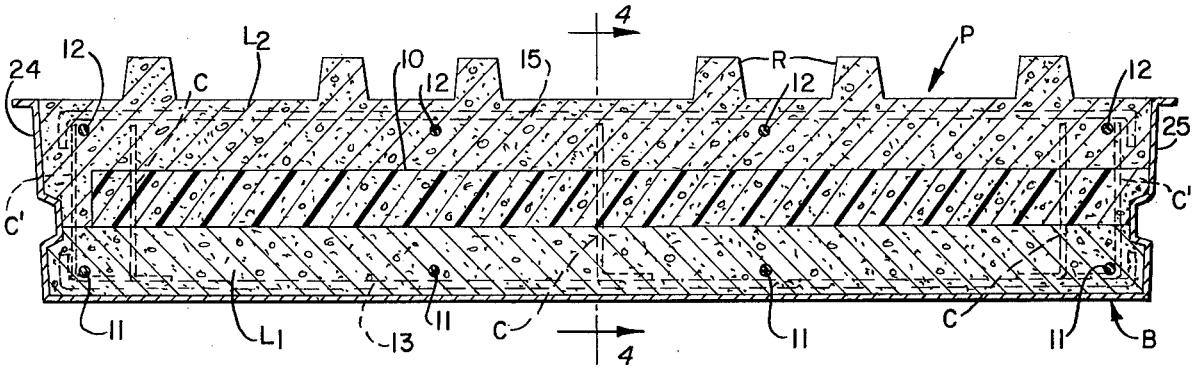
FIG. 3 is a greatly enlarged view in section taken along line 3—3 in FIG. 2.

In the drawings, wherein like reference numerals indicate like parts throughout the several views, a wall W comprises a plurality of panels P1, P2 and P3 in accordance with the invention assembled together in edge-to-edge relationship. The panels each comprise an inner layer L1 of concrete and an outer layer L2 of concrete, with a layer 10 of insulation sandwiched therebetween. A plurality of decorative ribs R, if desired, are cast or formed on the outer surface of the outer layer L2.

Figure 4:
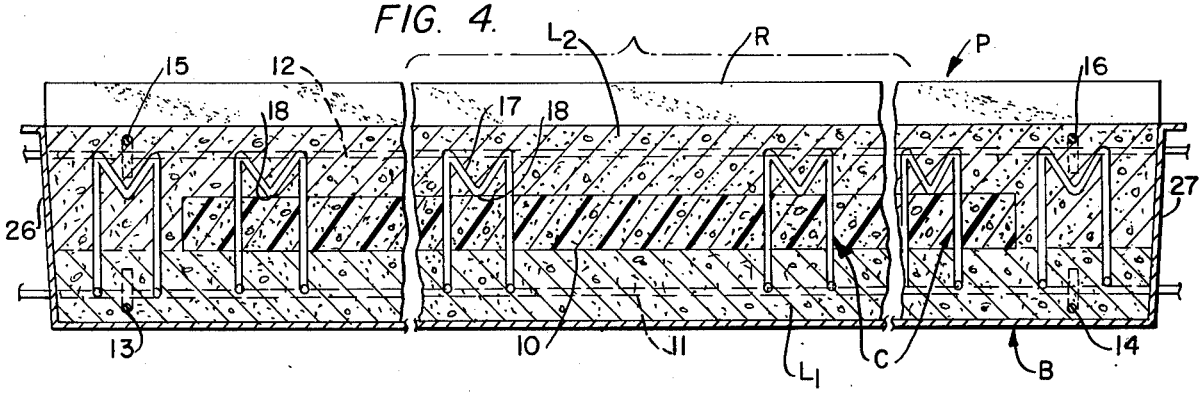
FIG. 4 is a view in section with portions broken away taken along line 4—4 in FIG. 3.
Figure 5:
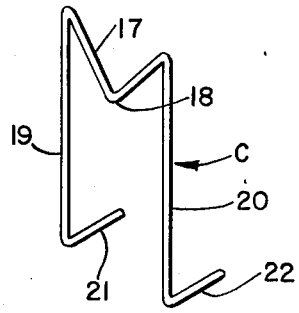
FIG. 5 is a perspective view of a shear connector according to the invention.

As seen best in FIGS. 2, 3 and 4, each panel P in one construction of the invention has a plurality of longitudinally extending prestressed reinforcing strands 11 embedded in the bottom or inner layer L1 and a similar plurality of longitudinally extending prestressed reinforcing strands 12 embedded in the outer or top layer L2. Additionally, generally staple-shaped reinforcing bars 13 and 14 are embedded in the bottom layer of concrete L1 adjacent the opposite ends thereof and similar staple-shaped reinforcing bars 15 and 16 are embedded in the top layer L2 adjacent the opposite ends thereof.

In accordance with the present invention, a plurality of unique shear connectors C are embedded within the panels and extend from within the top or outer layer L2 through the layer of insulation 10 and into the bottom or inner layer L1 to bond or secure the different layers together and thus define a composite panel. The shear connectors C comprise a top bar 17 bent downwardly in its middle to define a depth gauge 18. A pair of depending legs 19 and 20 project downwardly from opposite ends of the top bar 17 and the bottom ends of the legs 19 and 20 are bent rearwardly at 21 and 22. As seen in FIGS. 2 and 3, the connectors C are installed in one construction of the invention with the plane of the legs 19 and 20 extending generally parallel to the longitudinal axis of the panel. Moreover, and importantly, the depth gauge 18 formed in the top bar 17 of the connectors C is in contacting relationship with the top surface of the layer 10 of insulation, thus accurately positioning the shear connector relative to the inner and outer surfaces of the panel.

In this connection, one specific panel constructed in accordance with the invention has inner and outer layers L1 and L2 of concrete of approximately 3 inch thickness and a layer 10 of insulation of approximately two inch thickness. The shear connectors C are each approximately 6 inches long from the top bar 17 to the bottom ends of legs 19 and 20, and the depth gauge 18 is approximately 2 inches below the top ends of the legs 19 and 20. Accordingly, when the shear connector is positioned as shown in FIG. 4, for example, approximately 1 inch of concrete covers the top and bottom ends of the shear connectors. Additionally, it is preferred that the shear connectors be constructed of $\frac{1}{4}$ inch diameter mild steel galvanized wire.

Figure 6:
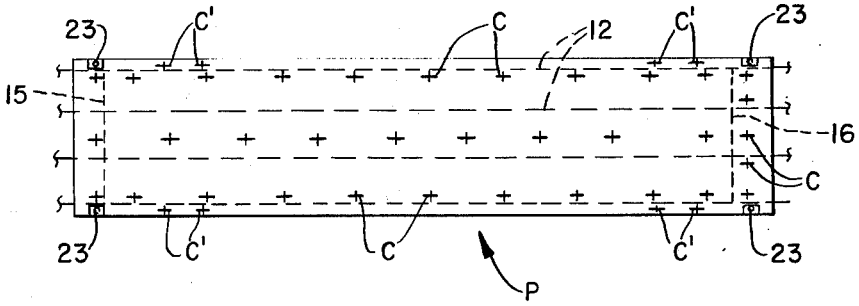
FIG. 6 is a somewhat schematic plan view of a panel in accordance with the invention showing the relative placement of shear connectors therein.

A typical panel constructed in accordance with the present invention is indicated somewhat schematically at P in FIG. 6. This panel is approximately 4 feet wide and 20 feet long and has three rows of connectors C extending longitudinally thereof. The number of rows would be increased proportionately as the width of the panel is increased. For example, a panel 8 feet wide would preferably have six rows of shear connectors C extending longitudinally thereof, and additional connectors C′ are provided at four locations adjacent opposite side edges of the panel at the opposite ends thereof at the lifting points for handling the panel. Further, conventional attaching means 23 are provided at the opposite corners of the panel for attaching the panel to a building structure. Of course, the insulating layer could have a greater thickness than the concrete, and the inner and outer layers or wythes of concrete could be of different thicknesses. For example, if the wall is used as a full load bearing wall, the inner wythe may be thicker than the outer wythe.

The unique shear connectors of the present invention enable the length of the panel to be increased nearly 25% over prior art constructions and approximately 25% fewer shear connectors are required than are required in prior art constructions.

In manufacturing the panel in accordance with the invention, a first layer or inner wythe of concrete L1 is cast in the bed B of a suitable production line by means of a conventional casting machine. The bed B includes elongate, longitudinally extending side walls 24 and 25 which are releasable or removable as is conventional in the art to enable a completed panel to be removed from the casting bed. Moreover, the bed B also includes end walls 26 and 27 with suitable header structures (not shown) associated therewith for prestressing the strands 11 and 12. Thus, initially the bottom strands 11 are positioned and prestressed and the bottom or inner wythe L1 of concrete is cast. The layer of insulation 10 is then placed over the bottom layer immediately after it is cast and the shear connectors C are then inserted through the layer of insulation into the inner wythe of concrete. The depth gauge portions 18 of the shear connectors indicate the proper degree of insertion of the shear connectors. Thereafter, the top reinforcing strands 12 are positioned and prestressed and the top layer or outer wythe L2 of concrete is then cast in place. After the concrete has cured, the panel is cut to appropriate lengths and removed for use as desired.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. In a reinforced insulated concrete building panel having an inner layer of concrete, an outer layer of concrete, a layer of insulating material sandwiched therebetween, and prestressed reinforcing strands extending longitudinally through the inner and outer layers of concrete, the improvement comprising a plurality of reinforcing shear connectors embedded in the inner layer of concrete and extending through the layer of insulation into the outer layer of concrete to bond the layers together into a composite panel and to prevent delamination failure of the panel, said shear connectors each being spaced from all of the reinforcing strands, each shear connector being generally U-shaped, and having a pair of depending legs joined at one of their ends to a bight portion, the bight portion being bent downwardly in the central portion thereof to extend generally in the same direction as the legs to define a depth gauge, whereby the legs may be inserted through the layer of insulating material and into one of said layers of concrete until the depth gauge contacts the layer of insulating material, thus leaving a portion of the shear connector exposed above the layer of insulating material, the other ends of each of the depending legs having terminal portions extending in a common direction at approximately a right angle to the axis of the leg to form a secure bond between the one layer of concrete and the shear connector, said terminal portions being spaced from all of said reinforcing strands whereby said shear connectors are in spaced relationship with said reinforcing strands, said shear connectors being positioned such that the legs thereof lie in a plane generally parallel to the longitudinal axis of the panel, whereby during manufacture of the panel the shear connector can be readily accurately and securely positioned at a proper depth in the panel.

2. A panel as in claim 1, wherein the shear connectors are each embedded an equal amount in the layers of concrete.

3. A panel as in claim 1, wherein the inner and outer layers of concrete each have substantially the same thickness and the layer of insulating material is of a lesser thickness.

* * * * *